US006761624B2

(12) United States Patent
Wang et al.

(10) Patent No.: US 6,761,624 B2
(45) Date of Patent: Jul. 13, 2004

(54) CHEMICAL MECHANICAL POLISHING APPARATUS

(75) Inventors: Shan-Chang Wang, Taoyuan Hsien (TW); Hsin-Chuan Tsai, Taoyuan (TW)

(73) Assignee: Nanya Technology Corporation, Taoyuan (TW)

( * ) Notice: Subject to any disclaimer, the term of this patent is extended or adjusted under 35 U.S.C. 154(b) by 180 days.

(21) Appl. No.: 10/053,161

(22) Filed: Jan. 15, 2002

(65) Prior Publication Data

US 2002/0142711 A1 Oct. 3, 2002

(30) Foreign Application Priority Data

Apr. 3, 2001 (TW) ..... 90205132 U

(51) Int. Cl.[7] ..... B24B 41/06

(52) U.S. Cl. ..... 451/288; 451/460; 451/411

(58) Field of Search ..... 451/288, 5, 66, 451/67, 411, 460

(56) References Cited

U.S. PATENT DOCUMENTS 5,329,732 A * 7/1994 Karlsrud et al. ..... 451/289
5,934,984 A * 8/1999 Togawa et al. ..... 451/288
6,358,126 B1 * 3/2002 Jackson et al. ..... 451/65

* cited by examiner

*Primary Examiner*—Robert A. Rose
(74) *Attorney, Agent, or Firm*—Ladas & Parry

(57) ABSTRACT

A chemical mechanical polish apparatus comprises a platen having a polishing pad thereon, a wafer carrier holding a wafer on the polishing pad, and a pusher. The pusher has a base disk and at least two guiding structures at the rim of the base disk. Each guiding structure has a shell with an opening, an elastic device and a pin moving through the opening, wherein the opening is non-linear.

11 Claims, 8 Drawing Sheets

CHEMICAL MECHANICAL POLISHING APPARATUS

BACKGROUND OF THE INVENTION

1. Field of the Invention

The present invention relates in general to a chemical mechanical polishing (CMP) apparatus. In particular, the present invention relates to a pusher for the CMP apparatus.

2. Description of the Related Art

A process commonly used in fabrication of integrated circuits to create a planar topography is chemical mechanical polishing (CMP). This process involves chemically removing a surface while also mechanically grinding or polishing it. The combined action of surface chemical reaction and mechanical polishing allows for a controlled, layer by layer removal of a desired material from the wafer surface, resulting in a preferential removal of protruding surface topography and a planarized wafer surface.

FIG. 1 schematically illustrates a conventional CMP apparatus 100 with a platen 110, a pusher 120, and a wafer carrier 150.

The pusher 120, as shown in FIG. 3, comprises a base disk 134 supported by a support 138, a plurality of guiding structures 122 at the rim of the base disk 134, and a plurality of brackets between the guiding structures 122. The support 138 can lower or raise the pusher 120. Each guiding structure 122 has a shell 124 with an opening 126 (as shown in FIG. 4*a*), a pin 128 moving through the opening 126, and an elastic device (not shown), such as a spring, for raising and lowering the pin 128. Each pin 128 is a metal bar. The upper part of the pin 128 (as shown in FIG. 4*b*) is tapered so that the wafer can slide down and be guided to deposit on the brackets 136.

One end of the shell 124 is the opening 126, and the other end is closed. Two fins 130 are disposed at the shell 124 and near the other end of the shell 124. A hole 132 is positioned in each fin 130 so as to connect the guiding structure 122 and the base disk 134.

As shown in FIG. 4*c*, each pin 128 is put inside the corresponding shell 124 and protrudes from the opening 126. The pin 128 can be lowered and raised by the elastic device. When the pin 128 is pushed, it can be lowered in the shell 124. The opening 126 is rectangular with keyholed corners, as shown in FIG. 4*d*.

FIG. 2(*a*) and (*b*) show the top view and the side view of the CMP apparatus 100 respectively. The wafer carrier 150 includes a guide ring 152, a top ring 154 and a backing ring 156. The top ring 154 is supported by the backing ring 156, and the guide ring 152 is positioned on the outer periphery of the top ring 154.

A wafer 102 is deposited on the pusher 120 as following. The wafer 102 is deposited on the top of the brackets 136 guided by pins 128 of the guiding structure 122. The pusher 120 is pushed by the support 138 to the wafer carrier 150 and contacts the guide ring 152 of the wafer carrier 150. The pins 128 are lowered into shells 124 so that the wafer 102 can be drawn by vacuum into the space constituted by the guide ring 152 and the backing ring 156. The wafer 102 held by the wafer carrier 150 is transferred to the platen 110.

A polyester polishing pad 112 is positioned on the platen 110, and a slurry from a nozzle 160 is positioned on the polishing pad 112.

The wafer 102 held by the wafer carrier 150 faces downward against the polishing pad 102, and then the platen 110 and the wafer carrier 150 move relative to one another, whereby the surface of the wafer 102 is polished. After polishing, the wafer carrier 150 carries the wafer 102 out of the platen 110 and onto the pusher 120. The pusher 120 is then raised, and the pins 128 of the guiding structures 122 contact the guide ring 152 of the wafer carrier 150. The pins 128 are lowered into shells 124 so that the wafer 102 can be deposited on the top of the brackets 136. The pusher 120 is then lowered.

After polishing, the wafer 102 is washed. However, some slurry may remain on the wafer 102. When the wafer 102 is positioned on the brackets 136 guided by the pins 128, the remaining slurry may flow along the pins 128 into the gap between the pins 128 and the shells 124. If the slurry is dry, some particles are formed at the gap obstructing the movement of the pins 128. The pins 128 cannot guide the wafer 102 normally, and may stick inside the shells 124. In this situation, the wafer 102 cannot be positioned exactly on the top of brackets 136 and parts of the wafer 102 may slide out of the pusher 120. For this reason, when transferring the wafer 102 to the wafer carrier 150, although the wafer 102 can be carried by the wafer carrier 150, the wafer 102 cannot be positioned exactly on the space constituted by the guiding ring 152, and the backing ring 156, as shown in FIG. 5. A part of the wafer 102 is outside the wafer carrier 150. Moreover, the wafer 102 may become deformed due to a vacuum force. When the wafer 102 is polished, a force is applied in the downward vertical direction against wafer 102 and presses the wafer 102 against the polishing pad 112. However, in this situation, the wafer 102 may be broken, and the fragments damage the polishing pad 112 and the backing ring 156. It wastes time and money to shut down the CMP apparatus 100 to clean it.

SUMMARY OF THE INVENTION

The present invention provides a chemical mechanical polishing (CMP) apparatus, comprising: a platen with a polishing pad thereon, a wafer carrier, and a pusher. The wafer carrier holds a wafer on the polishing pad, and can move on to and off of the polishing pad. The pusher has a base disk and at least two guiding structures at the rim of the base disk. Each guiding structure has a shell with an opening, an elastic device and a pin moving through the opening, wherein the opening is non-linear.

For the CMP apparatus, a plurality of brackets are disposed between the guiding structures. The opening is composed of two pairs of sides, and at least one pair of sides is concave or convex.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE PREFERRED EMBODIMENT

Figure 1:
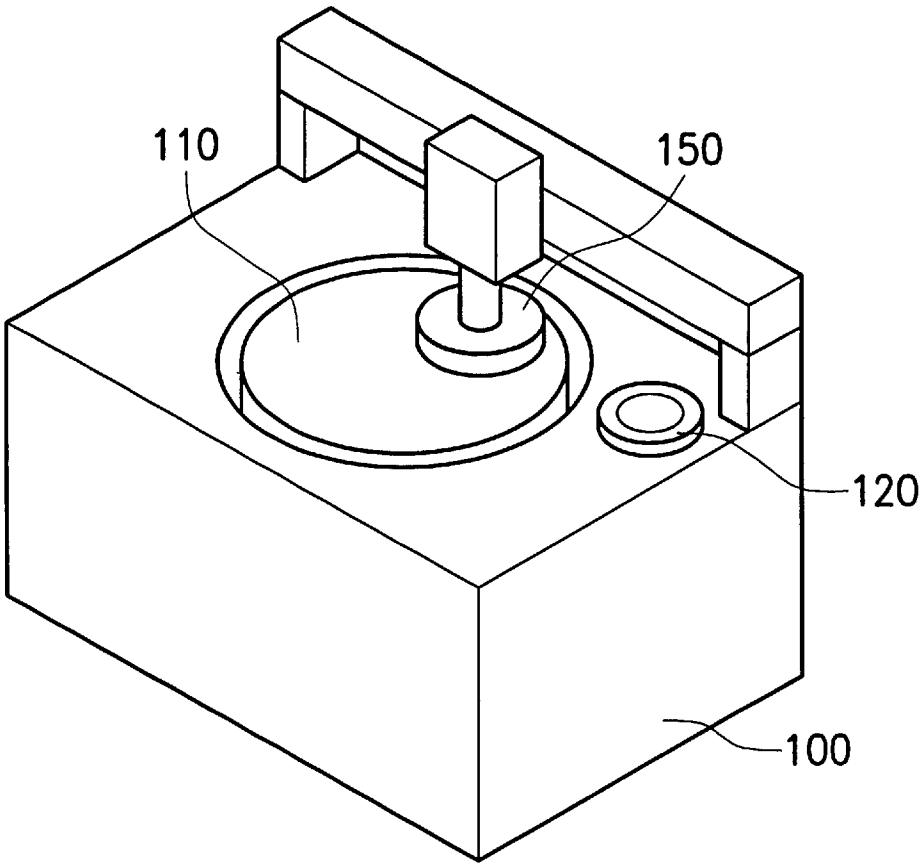
FIG. 1 (PRIOR ART)
FIG. 1 is a CMP apparatus according to the prior art.
Figure 2A:
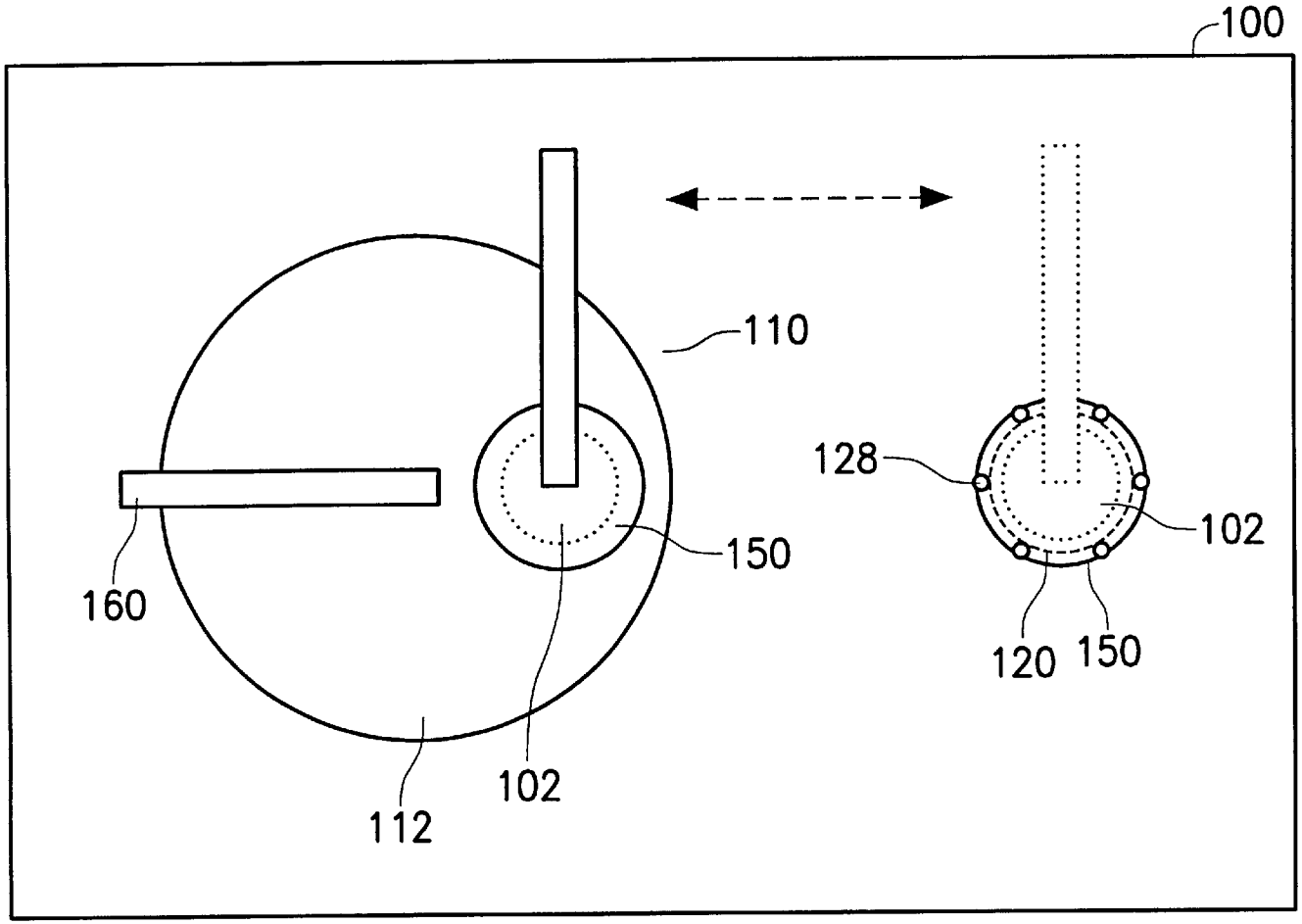
FIG. 2a (PRIOR ART)
FIGS. 2*a* and 2*b* show the top view and the side view of the CMP apparatus in FIG. 1 respectively.
Figure 2B:
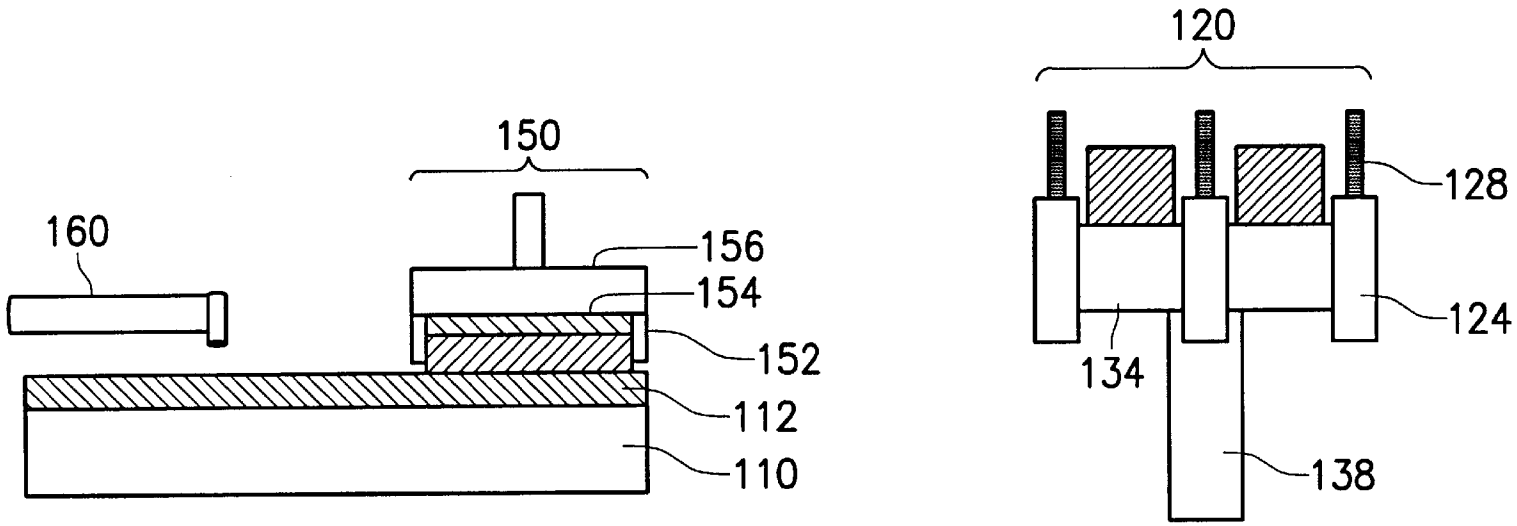
FIG. 2b (PRIOR ART)
Figure 3:
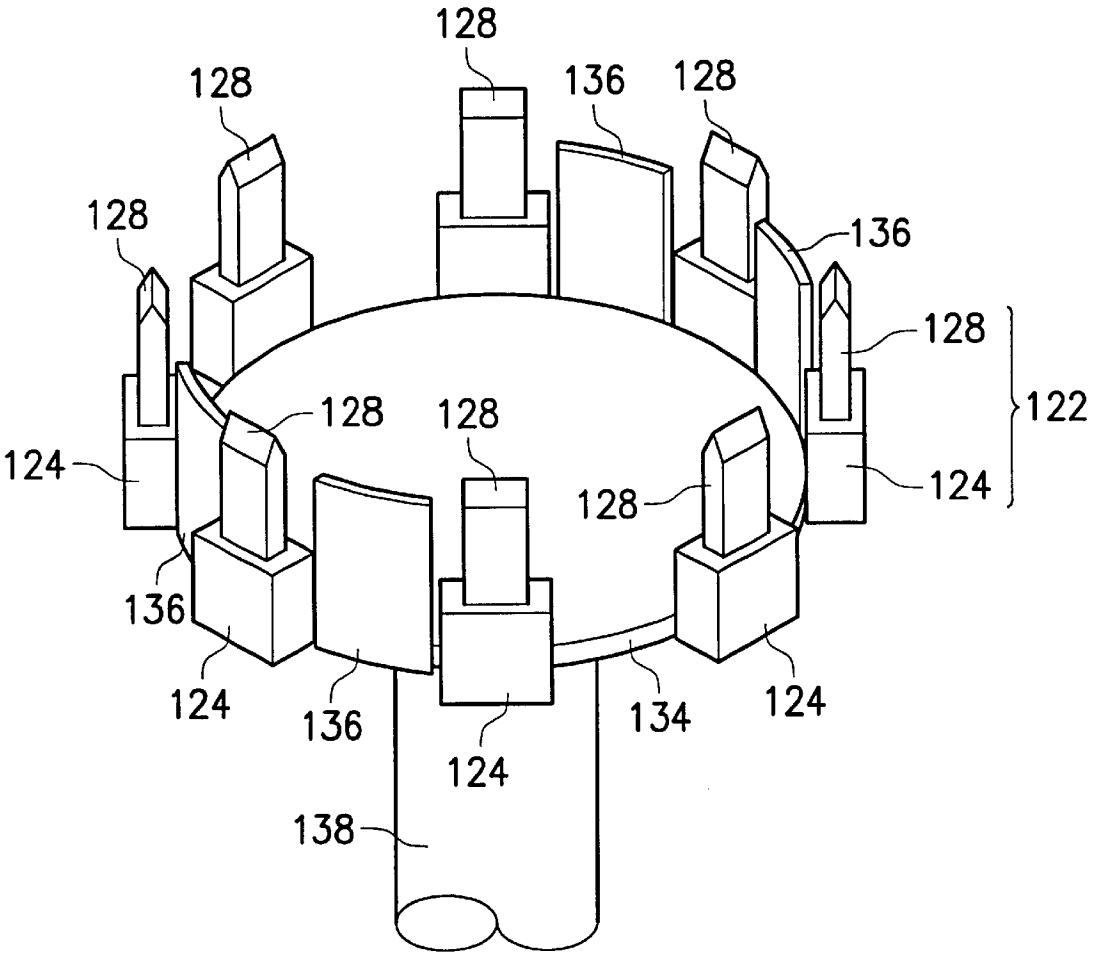
FIG. 3 (PRIOR ART)
FIG. 3 is a pusher of the CMP apparatus in FIG. 1.
Figure 4B:
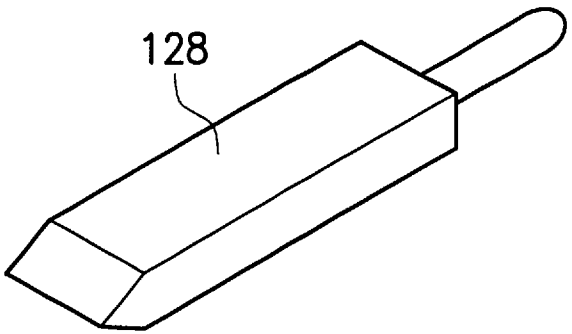
FIG. 4b (PRIOR ART)
FIGS. 4*a*~4*d* are a pin and the corresponding shell of the pusher in FIG. 3.
Figure 4A:
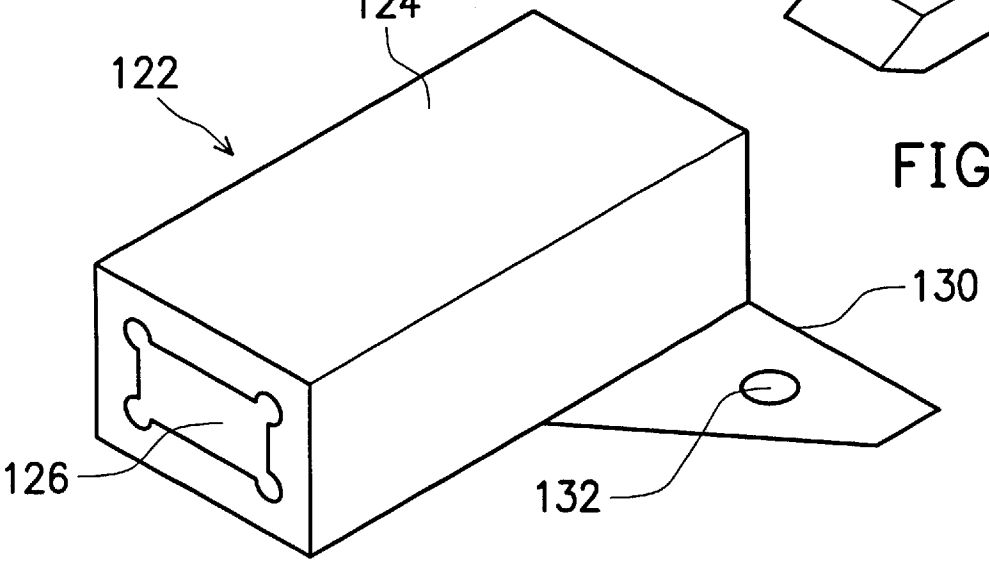
FIG. 4a (PRIOR ART)
Figure 4D:
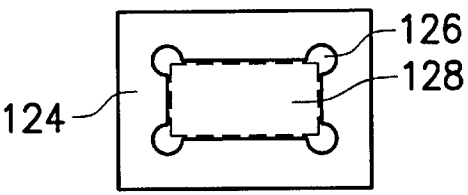
FIG. 4d (PRIOR ART)
Figure 4C:
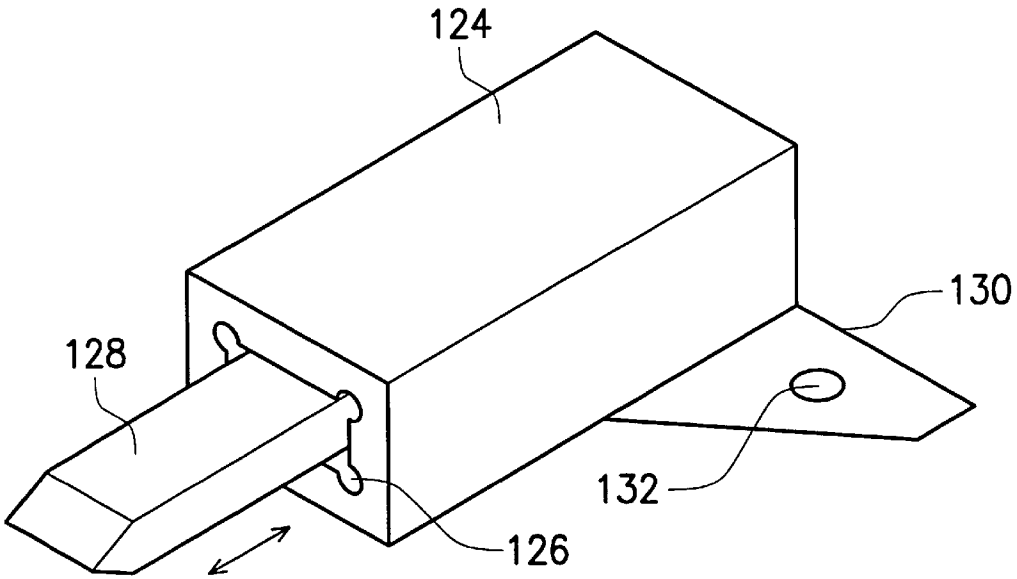
FIG. 4c (PRIOR ART)
Figure 5:
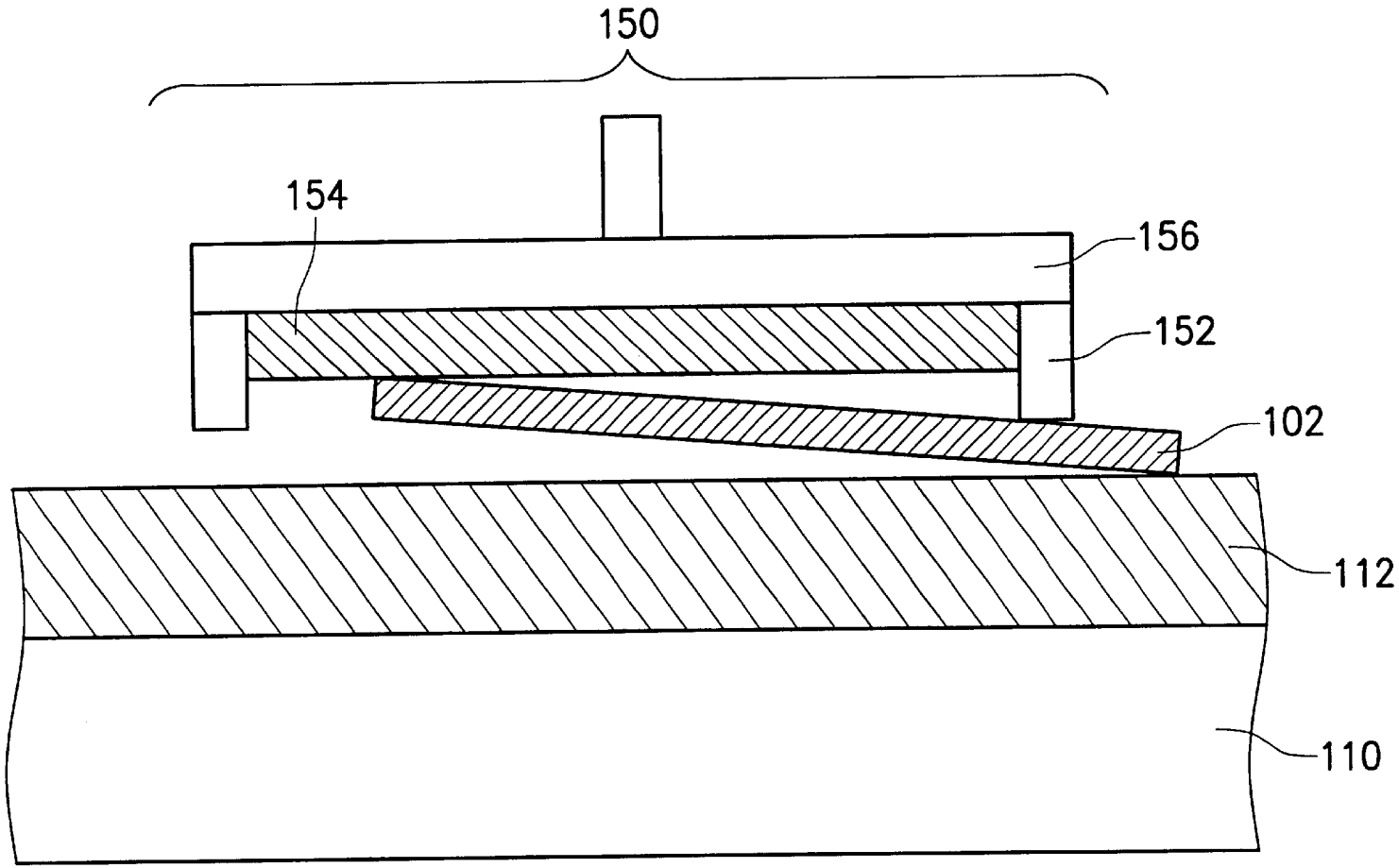
FIG. 5 (PRIOR ART)
FIG. 5 shows a wafer carrier holding a wafer in abnormal situation.

In the present invention, the gap between the shell 124 of the guiding structure 122 and its corresponding pin 128 is enlarged by changing the shape of its corresponding opening 126. The opening 126 has two pairs of sides 127*a* and 127*b*, and at least one pair of sides 127*a* or 127*b* are non-linear, such as concave or convex. The corners 129 of the opening 126 are keyholed. The shape and size of the pin 128 does not change.

Figure 6A:
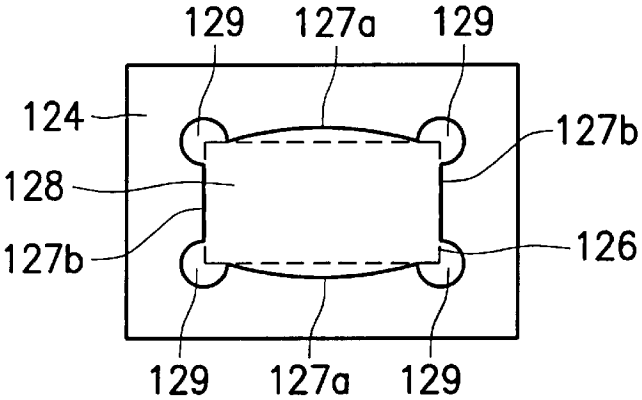
FIG. 6*a*~6*d* show the shells according to the embodiment of the present invention.

As shown in FIG. 6*a*, the pair sides 127*a* are convex, and the other pair sides 127*b* are linear. The four corners 129 of the opening 126 are in position, so the pin 128 can keep its position stably.

Figure 6B:
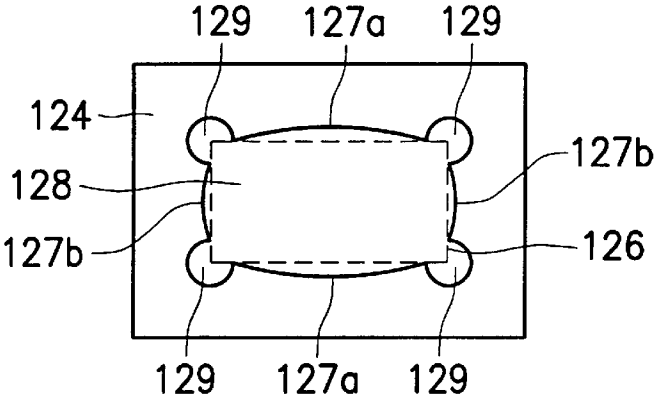

As shown in FIG. 6*b*, two pair sides 127*a* and 127*b* are all convex. The four corners 129 of the opening 126 are in position, so the pin 128 can keep its position stably.

Figure 6C:
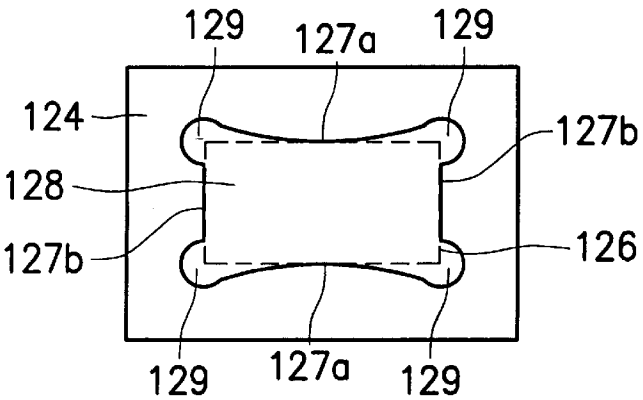

As shown in FIG. 6*c*, the sides 127*a* are concave, and the other sides 127*b* are linear. The apexes of the sides 127*a* contact the pin 128, so the pin 128 can keep its position stably.

Figure 6D:
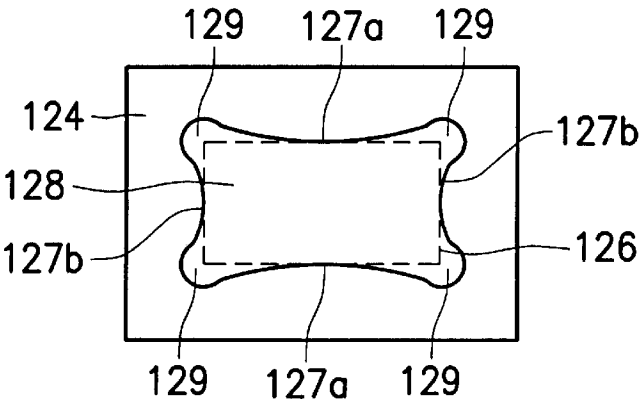

As shown in FIG. 6*d*, two pair sides 127*a* and 127*b* are all concave. The apexes of the sides 127*a* and 127*b* contact the pin 128, so the pin 128 can keep its position stably.

In the present invention, the shape of the opening 126 inside the shell 124 is improved, and the gap between the pin 128 and the wall inside the shell 124 is broadened. It should be noted that the shape of the pin 128 does not change. Therefore, the remaining slurry cannot obstruct the motion of the pin 128. It is easy to clean the particles from the remaining slurry inside the opening 126 of the shell 124. Moreover, the wafer 102 can be positioned on the wafer carrier 150 in position, and will not be broken.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A chemical mechanical polishing apparatus, comprising:

a platen having a polishing pad thereon;

a wafer carrier holding a wafer on the polishing pad, wherein the wafer carrier can move on to and off of the polishing pad; and a pusher having a base disk and at least two guiding structures at the rim of the base disk, wherein each guiding structure has a shell with an opening, an elastic device and a pin moving through the opening, wherein the opening comprises two pairs of sides with keyholing at corners, and the pairs of sides are convex with respect to the opening.

2. The CMP apparatus as claimed in claim 1, wherein the pusher further comprises a plurality of brackets between the guiding structures.

3. A chemical mechanical polishing apparatus, comprising:

a platen having a polishing pad thereon;

a wafer carrier holding a wafer on the polishing pad, wherein the wafer carrier can move on to and off of the polishing pad; and a pusher having a base disk and at least two guiding structures at the rim of the base disk, wherein each guiding structure has a shell with an opening, an elastic device and a pin moving through the opening, wherein the opening comprises two pairs of sides with keyholing at corners, and at least one pair of sides is non-linear with respect to the opening.

4. The CMP apparatus as claimed in claim 3, wherein the pusher further comprises a plurality of brackets between the guiding structures.

5. The CMP apparatus as claimed in claim 3, wherein at least one pair of sides of the opening are concave with respect to the opening.

6. The CMP apparatus as claimed in claim 3, wherein at least one pair of sides of the opening are convex with respect to the opening.

7. A chemical mechanical polishing apparatus, comprising:

a platen having a polishing pad thereon;

a wafer carrier holding a wafer on the polishing pad, wherein the wafer carrier can move on to and off of the polishing pad; and a pusher having a base disk and at least two guiding structures at the rim of the base disk, wherein each guiding structure has a shell with an opening, an elastic device and a pin moving through the opening, wherein the opening comprises two pairs of sides with keyholing at corners, and the pairs of sides are concave with respect to the opening.

8. The CMP apparatus as claimed in claim 7, wherein the pusher further comprises a plurality of brackets between the guiding structures.

9. The CMP apparatus as claimed in claim 1, wherein the the pairs of sides are convex in the middle part.

10. The CMP apparatus as claimed in claim 3, wherein the at least one pair of sides is non-linear in the middle part.

11. The CMP apparatus as claimed in claim 7, wherein the pairs of sides are concave in the middle part.

* * * * *